US006894019B2

(12) United States Patent
Oki et al.

(10) Patent No.: US 6,894,019 B2
(45) Date of Patent: May 17, 2005

(54) BASE PARTICLES AND DETERGENT PARTICLES

(75) Inventors: Kazuo Oki, Wakayama (JP); Hiroji Hosokawa, Wakayama (JP); Shu Yamaguchi, Wakayama (JP); Kimihiro Mizusawa, Wakayama (JP)

(73) Assignee: Kao Corporation, Tokyo (JP)

( * ) Notice: Subject to any disclaimer, the term of this patent is extended or adjusted under 35 U.S.C. 154(b) by 295 days.

(21) Appl. No.: 10/020,166

(22) Filed: Dec. 18, 2001

(65) Prior Publication Data

US 2002/0123450 A1 Sep. 5, 2002

(30) Foreign Application Priority Data

Dec. 18, 2000 (JP) ..... 2000-384526

(51) Int. Cl.[7] ..... C11D 3/08

(52) U.S. Cl. ..... 510/507; 510/276; 510/315; 510/318; 510/323; 510/377; 510/398; 510/485; 510/511; 510/531; 510/532

(58) Field of Search ..... 510/276, 315, 510/318, 323, 377, 398, 485, 507, 511, 531, 532

(56) References Cited

U.S. PATENT DOCUMENTS

| | | | | |
|---|---|---|---|---|
| 4,129,511 A | | 12/1978 | Ogoshi et al. | |
| 4,248,847 A | | 2/1981 | Derleth et al. | |
| 4,379,080 A | * | 4/1983 | Murphy | 510/350 |
| 4,399,048 A | | 8/1983 | Gangwisch et al. | |
| 4,483,781 A | * | 11/1984 | Hartman | 510/374 |
| 4,560,492 A | * | 12/1985 | Curry et al. | 510/340 |
| 5,183,650 A | * | 2/1993 | Goto et al. | 423/710 |
| 6,376,453 B1 | | 4/2002 | Kubota et al. | |

FOREIGN PATENT DOCUMENTS

| | | | |
|---|---|---|---|
| EP | 0 520 582 A1 | | 12/1992 |
| EP | 0 969 082 A1 | | 1/2000 |
| EP | 1 104 806 A1 | | 6/2001 |
| JP | A-53-102898 | | 9/1978 |
| JP | A-54-147200 | | 11/1979 |
| JP | 56-59618 A | | 5/1981 |
| JP | 58-2399 A | | 1/1983 |
| JP | 61-138697 A | | 6/1986 |
| JP | 61-270211 A | | 11/1986 |
| JP | 3-504734 A | | 10/1991 |
| JP | 2000-345199 A | | 12/2000 |
| WO | WO99/29830 | | 6/1999 |
| WO | WO 01/34520 A1 | | 5/2001 |

* cited by examiner

*Primary Examiner*—Charles Boyer
(74) *Attorney, Agent, or Firm*—Birch, Stewart, Kolasch & Birch, LLP

(57) ABSTRACT

Base particles for supporting a surfactant, obtainable by a step of spray-drying a slurry comprising (A) a zeolite having an average aggregate particle diameter of 15 μm or less and a variation coefficient of a distribution of an aggregate particle diameter of 29% or less, (B) a water-soluble polymer; (C) a water-soluble salt, and (D) a surfactant in an amount of 5% by weight or less of the slurry; detergent particles comprising the base particles; and a zeolite for a laundry detergent, wherein the zeolite has an average aggregate particle diameter of 15 μm or less and a variation coefficient of a distribution of an aggregate particle diameter of 29% or less; and a process for preparing base particles for supporting a surfactant, comprising a step of spray-drying a slurry comprising a zeolite (A) having an average aggregate particle diameter of 15 μm or less and a variation coefficient of a distribution of an aggregate particle diameter of 29% or less, a water-soluble polymer (B), a water-soluble salt (C), and optionally a surfactant (D) so as to give base particles comprising 1 to 90% by weight of the zeolite (A), 2 to 25% by weight of the water-soluble polymer (B), 5 to 75% by weight of the water-soluble salt (C), and optionally 0 to 5% by weight of the surfactant (D).

13 Claims, 11 Drawing Sheets

(a)

(b)

(a)

(b)

(a)

(b)

(a)

(b)

(a)

(b)

(a)

(b)

(a)

(b)

(a)

(b)

BASE PARTICLES AND DETERGENT PARTICLES

BACKGROUND OF THE INVENTION

1. Field of the Invention

The present invention relates to base particles for supporting a surfactant useful for improvements in performance, mainly as laundry detergents (hereinafter referred to as "base particles"), with improved detergency, detergent particles, and a process for preparing the above-mentioned base particles. In addition, the present invention relates to a zeolite for a laundry detergent.

2. Discussion of the Related Art

In the development of high-density powdery detergents in the latter half of 1980's, the compactness of the powdery detergents greatly contributed to transport or carrying and housing ability of the detergents. Therefore, at present, compact detergents (high-density detergents) have become the main stream.

As to a process for preparing a high-density detergent, numerous studies have been so far made. One of its example is a technique for obtaining detergent particles comprising supporting a surfactant to base particles obtained by spray-drying as disclosed in, for instance, WO 99/29830. The detergent particles have the features of fast dissolubility and high disintegration.

Because the fast dissolubility and the high disintegration of the detergent particles as mentioned above advantageously act on the detergency, the present inventors have further studied in detail regarding the relationship of the dissolubility and the disintegration with the detergency of the detergent particles. As a result, they have found for the first time that the zeolite added as a water-insoluble inorganic compound greatly affects the detergency of the detergent particle. Specifically, each of 6 kinds of zeolite A-type having the same level of cationic exchange ability is added to base particles, to give detergent particles. The detergency of each group of the detergent particles is determined. As a result, the base particles obtained by adding each of the zeolites exhibit different cationic exchange abilities, and it has been clarified that such a difference of the cationic exchange abilities of each group of the base particles greatly affect the detergency of the detergent particles prepared from the base particles. The present inventors have pursued further studies on factors and causations for changing the cationic exchange ability of the base particles described above. As a result, they have found for the first time that the aggregation form of the added zeolite is greatly affected such that the more even the distribution of the aggregate particle diameter of a secondary aggregate obtained by aggregating primary particles of the zeolite alone, the higher the cationic exchange ability of the base particles containing the zeolite. Therefore, a zeolite having a more even distribution of the aggregate particle diameter than the above zeolite is prepared. The zeolite is added to base particles, and as a result, it has been confirmed that the resulting base particles exhibit an unexpectedly high cationic exchange ability.

The aggregation state of the zeolite can be acknowledged by using an electron microscope. Generally, it has been confirmed that cubic or spherical primary particles are collectively gathered to form a secondary aggregate. The particle diameter of the secondary aggregate is determined to obtain a distribution of the aggregate particle diameter. By subjecting the distribution of the aggregate particle diameter to a statistic treatment, the degree of dispersion of the distribution of the aggregate particle diameter is found. In other words, as a measure for expressing the degree of dispersion of the distribution of the aggregate particle diameter, it is convenient to use a standard deviation. However, the standard deviation can be applied to comparisons of those zeolites having the same average aggregate particle diameter. Therefore, in a case of those zeolites having different average aggregate particle diameters, a value obtained by dividing the standard deviation of the distribution of the aggregate particle diameter by the average aggregate particle diameter (in some cases multiplied by 100 and expressed as %, which is referred to as a variation coefficient in statistics) is a measure for expressing dispersion.

The variation coefficients of the distribution of the aggregate particle diameter of the above 6 zeolites are from 30.5% to 64.9%. It has been confirmed that the smaller the variation coefficients of the zeolite, namely those having an even distribution of the aggregate particle diameter of the zeolite, the higher the cationic exchange abilities of each group of the base particles containing the zeolite, and the higher the detergency of the resulting detergent particles.

In the zeolite for detergent builders, it has been known in the art that those zeolites having a narrow distribution of the aggregate particle diameter are preferable. For instance, the zeolite obtained by the process disclosed in Japanese Patent Laid-Open No. Sho 53-102898 has a narrow distribution of the aggregate particle diameter. The reasons for narrowing the distribution of the aggregate particle diameter are such that exceedingly fine particles tend to be adhered to fabrics and that coarse grains tend to be settled at bottom. Therefore, an object of this publication is to narrow the distribution of the aggregate particle diameter of the resulting zeolite used for laundry detergents from the viewpoint of prevention of residuality of zeolite on clothes. In addition, a zeolite obtained by the process disclosed in Japanese Patent Laid-Open No. Sho 54-147200 also has an aggregate particle diameter of roughly from 1 to 5 $\mu$m, from the viewpoint of re-deposition on clothes and the like. As described above, although the conventionally known zeolite has a narrow distribution of the aggregate particle diameter, the zeolite has a variation coefficient of from 29.9 to 43.0%. Therefore, a zeolite having a very even particle diameter distribution as 29% or less is not disclosed in the publication. Also, in WO 99/29830, a zeolite manufactured by Tosoh Corporation, which has an average aggregate particle diameter of 3.5 $\mu$m and a variation coefficient of 30.5%, is added to base particles. Therefore, the zeolite does not have any effects for improving the cationic exchange ability of the base particles as taught in the present invention; in fact, its detergency has been insufficient.

Accordingly, an object of the present invention is to provide base particles having excellent cationic exchange ability, and a process for preparing the base particles.

Another object of the present invention is to provide a zeolite for a laundry detergent used for the process for preparing the base particles, and detergent particles having excellent detergency.

These and other objects of the present invention will be apparent from the following description.

SUMMARY OF THE INVENTION

According to the present invention, there are provided:

[1] base particles for supporting a surfactant, obtainable by a step of spray-drying a slurry comprising:

(A) a zeolite having an average aggregate particle diameter of 15 $\mu$m or less and a variation coefficient of a distribution of an aggregate particle diameter of 29% or less;

(B) a water-soluble polymer;

(C) a water-soluble salt; and (D) a surfactant in an amount of 5% by weight or less of the slurry;

[2] detergent particles comprising the base particles of item [1] above;

[3] a zeolite for a laundry detergent, wherein the zeolite has an average aggregate particle diameter of 15 μm or less and a variation coefficient of a distribution of an aggregate particle diameter of 29% or less; and

[4] a process for preparing base particles for supporting a surfactant, comprising a step of spray-drying a slurry comprising a zeolite (A) having an average aggregate particle diameter of 15 μm or less and a variation coefficient of a distribution of an aggregate particle diameter of 29% or less, a water-soluble polymer (B), a water-soluble salt (C), and optionally a surfactant (D) so as to give base particles comprising:

1 to 90% by weight of the zeolite (A);

2 to 25% by weight of the water-soluble polymer (B);

5 to 75% by weight of the water-soluble salt (C); and optionally 0 to 5% by weight of the surfactant (D).

BRIEF DESCRIPTION OF THE DRAWINGS

FIG. 4(*b*) is a graph showing a distribution of an aggregate particle diameter of the zeolite obtained in Example 1;

FIG. 5(*b*) is a graph showing a distribution of an aggregate particle diameter of the zeolite obtained in Example 2;

FIG. 6(*b*) is a graph showing a distribution of an aggregate particle diameter of the zeolite obtained in Example 3;

FIG. 7(*b*) is a graph showing a distribution of an aggregate particle diameter of the zeolite used in Comparative Example 1;

FIG. 8(*b*) is a graph showing a distribution of an aggregate particle diameter of the zeolite used in Comparative Example 2;

FIG. 9(*b*) is a graph showing a distribution of an aggregate particle diameter of the zeolite used in Comparative Example 3;

FIG. 10(*b*) is a graph showing a distribution of an aggregate particle diameter of the zeolite used in Comparative Example 4; FIG. 11(*b*) is a graph showing a distribution of an aggregate particle diameter of the zeolite used in Comparative Example 5.

Figure 1:
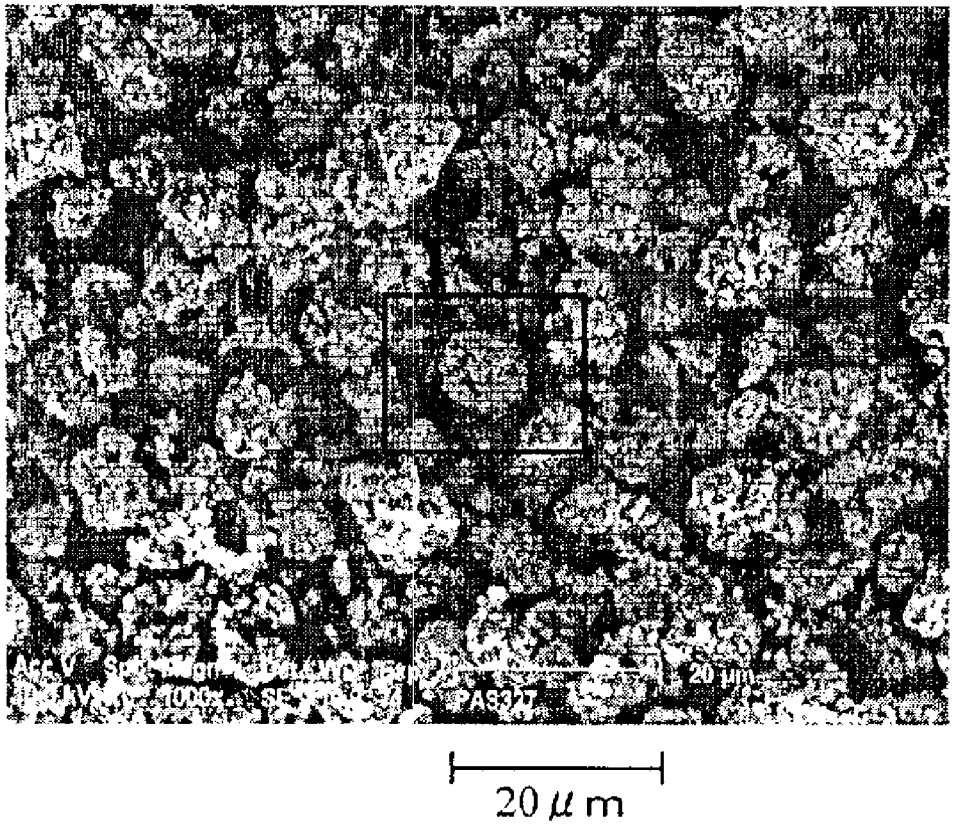
FIG. 1 is a SEM image of the zeolite of the present invention photographed at a magnification of 1000 by using a scanning electron microscope (SEM)

DETAILED DESCRIPTION OF THE INVENTION (I) Base Particles

The base particles of the present invention are obtained by a step of spray-drying a slurry comprising:

(A) a zeolite having an average aggregate particle diameter of 15 μm or less and a variation coefficient of a distribution of an aggregate particle diameter of 29% or less;

(B) a water-soluble polymer;

(C) a water-soluble salt; and (D) a surfactant in an amount of 5% by weight or less of the slurry.

Each of the substances (A) to (D) will be described below.

(A) Zeolite

The zeolite having an average aggregate particle diameter of 15 μm or less and a variation coefficient of a distribution of an aggregate particle diameter of 29% or less of the present invention (hereinafter referred to as "zeolite of the present invention") includes, for instance, zeolites of A-type, X-type, Y-type, P-type, and the like, among which zeolite A-type generally having excellent cationic exchange ability as a detergent builder is preferable. The zeolite A-type refers to those having X-ray diffraction patterns such that there are diffraction peaks at positions shown in zeolite 4A (No. 38-241) presented by Joint Committee on Powder Diffraction Standards (JCPDS).

The aggregate particle diameter of the zeolite of the present invention is determined by the microscope method described in Item (1-2) in Examples set forth below. As the microscope, a scanning electron microscope is used, and a maximal distance (also referred to as longest diameter) of the particle diameter of the aggregate particles in which the primary particles of zeolite are contacted and gathered together in an aggregated form is defined as an aggregate particle diameter. The aggregate particle diameter determined by this technique usually has a distribution, and a number-based frequency distribution is obtained. The number-average diameter calculated from the number-based distribution is defined as an average aggregate particle diameter D. The average aggregate particle diameter of the zeolite of the present invention is 15 μm or less, preferably 13 μm or less, more preferably 10 μm or less, from the viewpoint of preventing deposition of the aggregate on clothes.

In addition, a standard deviation a can be calculated from the above-mentioned number-based distribution, and a variation coefficient can be calculated by the equation:

$$(\text{Variation Coefficient})=[(\text{Standard Deviation } \sigma)\div(\text{Average Aggregate Particle Diameter } D)]\times 100.$$

This variation coefficient is an index of a distribution state of the aggregate particle. The smaller the variation coefficient, less the variance in the particle diameter, so that the particles are judged to have a more even particle diameter distribution. The zeolite of the present invention has a variation coefficient of 29% or less, preferably 28% or less, more preferably 25% or less, still more preferably 20% or less, from the viewpoint of improving the cationic exchange ability of the base particles obtained by adding such a zeolite.

The zeolite of the present invention can be prepared by the following embodiments:

(1) an embodiment of pulverizing a raw material zeolite; and (2) an embodiment of classifying a raw material zeolite.

The raw material zeolite used in the embodiments (1) and/or (2) is not particularly limited, as long as the raw material zeolite has a variation coefficient exceeding 29%. A commercially available zeolite for detergent builder or the like can be used. The cationic exchange ability of the raw material zeolite is evaluated by a Ca ion exchange capacity when a raw material zeolite is added to an aqueous calcium chloride solution (100 ppm, calculated as $CaCO_3$) at a temperature of 10° C. so as to have a concentration of 0.4 g/L, and the resulting mixture is subjected to cation-exchanging for 1 minute or 10 minutes (detailed determination method being given in Item (1-3) of Examples set forth below). The 1-minute cationic exchange ability of the raw material zeolite is preferably 70 mg $CaCO_3$/g or more, more preferably 80 mg $CaCO_3$/g or more, especially preferably 100 mg $CaCO_3$/g or more, as determined by the determination method described in Item (1-3) of Examples set forth below, from the viewpoint of making the cationic exchange ability of the zeolite of the present invention obtained in the embodiments (1) and/or (2). In addition, for the same reasoning, the 10-minute cationic exchange ability of the raw material zeolite is preferably 170 mg $CaCO_3$/g or more, more preferably 180 mg $CaCO_3$/g or more, especially preferably 190 mg $CaCO_3$/g or more.

In addition, the primary particle diameter of the raw material zeolite is preferably 2 $\mu$m or less, more preferably 1.5 $\mu$m or less, especially preferably 1 $\mu$m or less, as determined by the determination method described in Item (1-1) of Examples set forth below, from the viewpoint of improving the cationic exchange speed of the zeolite of the present invention obtained in the after-treatment.

Next, the embodiments of Items (1) and (2) are sequentially described.

First, in the embodiment (1), as the pulverization method, there can be used, for instance, pulverizers described in *Kagaku Kogaku Binran Edited by Kagaku Kogakukai* (published by Maruzen Publishing, 1988), Fifth Edition, p. 826–838. The pulverization may be wet pulverization or dry pulverization. When the zeolite of the present invention is added in a form of a slurry to the detergent composition, the wet pulverization is more preferable, from the viewpoint of simplification of the preparation steps. The dispersion medium to be used in the wet pulverization other than water includes alcohol solvents such as ethanol, surfactants such as polyoxyethylene alkyl ethers, polymer dispersants, and the like. The dispersion medium can be used alone or as a mixed solution of two or more kinds. When the wet pulverization is carried out, the concentration of the raw material zeolite in the slurry is preferably 5% by weight or more, more preferably 10% by weight or more, from the viewpoint of productivity. The concentration of the raw material zeolite in the slurry is preferably 60% by weight or less, more preferably 50% by weight or less, from the viewpoint of handling ability of the slurry of the raw material zeolite during wet pulverization and from the viewpoint of prevention of re-aggregation of the zeolite after pulverization. It is preferable that the zeolite of the present invention after pulverization has an average aggregate particle diameter which is equal to or greater than the primary particle diameter of the raw material zeolite before pulverization. When the raw material zeolite is pulverized to a size such that the average aggregate particle diameter is smaller than the primary particle diameter of the raw material zeolite before pulverization, constituting ions such as Si, Al and Na of the zeolite are undesirably eluted in large amounts due to the disintegration of the primary particles of the zeolite. As a result, when the resulting pulverized zeolite is formulated in the detergent composition, some drawbacks such as lowered dispersibility and reduced detergency are brought about. In addition, excess-pulverization which leads to disintegration of the primary particles causes acceleration of the aggregation of the particles, or the like, so that the aggregate particle diameter becomes uneven, and that the variation coefficient is likely to increase, thereby making it unfavorable for obtaining the zeolite of the present invention.

Next, the embodiment (2) will be explained. The distribution of the aggregate particle diameter of the raw material zeolite can be made more even by classification. As the classification method, there can be employed, for instance, a classification process described in *Kagaku Kogaku Binran Edited by Kagaku Kogakukai* (published by Maruzen Publishing, 1988), Fifth Edition, p. 795–809. The classification may be wet classification or dry classification, and the wet classification is preferable from the viewpoint of classification accuracy. The dispersion medium for wet classification other than water includes alcohol solvents such as ethanol, and the like. When the wet classification is carried out, the concentration of the raw material zeolite in the slurry during classification is preferably 5% by weight or more, more preferably 10% by weight or more, from the viewpoint of productivity. The concentration of the raw material zeolite in the slurry is preferably 40% by weight or less, more preferably 30% by weight or less, from the viewpoint of classification accuracy. For instance, when the zeolite is classified at 20° C. by utilizing gravity settling in the raw material zeolite at a concentration of a 20% by weight aqueous solution, the settling time period is preferably from 1 to 24 hours, more preferably from 6 to 18 hours, from the viewpoint of classification accuracy. In addition, when the classification accuracy is low, the classification accuracy can be increased by feeding the dispersion medium again to evenly disperse the zeolite and repeatedly carrying out classification.

Each of the above-mentioned two embodiments for preparing the zeolite of the present invention having an even distribution of an aggregate particle diameter can be used alone or in combination.

The zeolite of the present invention is obtained by subjecting a raw material zeolite to a secondary treatment as described in the embodiments (1) and (2). Alternatively, the zeolite of the present invention can be directly obtained by an embodiment described below without requiring treatments such as embodiments (1) and (2). Since this embodiment does not necessitate a secondary treatment process such as classification or pulverization, it is an especially preferable embodiment. This embodiment is as follows:

(3) In a process of preparing zeolite comprising feeding an aluminum source and/or a silica source to a circulating line of a reaction vessel having the circulating line with a mixing device to react the components, a vigorous stirring is carried out at a peripheral speed of the mixing device of not less than 11 m/s.

Concretely, in a process of preparing a zeolite of which anhydride form has a general compositional formula of $xM_2O.ySiO_2.Al_2O_3.zMeO$, wherein M is an alkali metal atom, Me is an alkaline earth metal atom, x is from 0.5 to 1.5, y is from 0.5 to 6, and z is from 0 to 0.1, the mixing of an aluminum source and/or a silica source in the line is carried out with vigorously stirring, to give a zeolite of the present invention.

In this embodiment, it is preferable that each of the silica source and the aluminum source is, for instance, in the form of a solution from the viewpoints of homogeneity of the reaction and dispersibility. For instance, as the silica source, a commercially available water glass is preferably used. In some cases, water or sodium hydroxide is added to the water glass to adjust its composition and concentration and supplied as a silica source. In addition, the aluminum source includes, for instance, aluminum hydroxide, aluminum sulfate, aluminum chloride, an alkali aluminate, and the like. Among them, sodium aluminate is especially preferable. Sodium hydroxide or water may be added to each of these aluminum sources to adjust its molar ratio and concentration and supplied as an aluminum source. For instance, aluminum hydroxide and sodium hydroxide are mixed in water and thereafter heated and dissolved to give an aqueous sodium aluminate solution, and the resulting solution is added to water with stirring to give an aqueous solution of an aluminum source. In addition, the adjustments of the molar ratio and the concentration described above can be carried out, for instance, by previously supplying water into a reaction vessel, and adding a high-concentration alkali metal aluminate solution and an alkali hydroxide thereto.

In addition, a zeolite having a more even distribution of the aggregate particle diameter can be obtained by the coexistence of an alkaline earth metal-containing compound during the reaction of the silica source and the aluminum source mentioned above. The alkaline earth metal to be coexistent in the reaction system includes Mg, Ca, Sr, Ba, and the like. Among them, Mg and Ca are preferably used. Those alkaline earth metal-containing compounds can be added to the reaction system as hydroxides, carbonates, sulfates, chlorides, nitrates, and the like of alkaline earth metals. Among them, water-soluble salts are preferable from the viewpoint of homogeneity of the reaction, and an aqueous chloride solution of Mg, Ca or the like is especially preferable. These alkaline earth metal salts may be coexistent with these components during the reaction of the silica source and the aluminum source. Especially, it is preferable that the alkaline earth metal-containing compound is previously added to the silica source and/or the aluminum source in the form of an aqueous solution or a slurry. It is more preferable that the alkaline earth metal-containing compound is added to the silica source. Thereafter, these silica source and aluminum source are mixed with each other to carry out the reaction for preparing the zeolite of the present invention.

In the present specification, the phrase "previously add" refers to an embodiment of a process where an alkaline earth metal-containing compound is previously substantially homogeneously mixed with a silica source and/or an aluminum source before feeding the silica source and the aluminum source. An example thereof includes, for instance, an embodiment of a process where an alkaline earth metal-containing compound is directly added to a silica source and/or an aluminum source and mixed therewith, and thereafter the silica source is mixed with the aluminum source to carry out the reaction. The phrase also refers to another embodiment of a process where the alkaline earth metal-containing compound is mixed part of the way of feeding the silica source and/or the aluminum source, so that it is not necessitated that an alkaline earth metal-containing compound is directly added to and mixed with a silica source and/or an aluminum source. An example thereof includes, for instance, an embodiment of a process comprising carrying out line-mixing wherein a feed line for a silica source and/or an aluminum source is linked with a feed line for an alkaline earth metal-containing compound at a position immediately before a circulating line for line-mixing. Alternatively, a process may comprise directly supplying an alkaline earth metal-containing compound to a reaction tank.

The above-mentioned alkaline earth metal-containing compound reacts with a silica source or an aluminum source to form a hardly soluble micro-core comprising an alkaline earth metal silicate, an alkaline earth metal aluminate or the like in the reaction system, so that an amorphous aluminosilicate or zeolite is homogeneously formed with its core as a starting point, thereby consequently acting to make the distribution of the aggregate particle diameter of the resulting zeolite even.

As the starting composition when the silica source and the aluminum source mentioned above, and optionally the alkaline earth metal-containing compound are reacted, for instance, the $SiO_2/Al_2O_3$ molar ratio of the total raw materials used is preferably 0.5 or more, more preferably 1.5 or more, from the viewpoint of crystal structure stability. Also, the $SiO_2/Al_2O_3$ molar ratio is preferably 6 or less, more preferably 4 or less, especially preferably 2.5 or less, from the viewpoint of improving cationic exchange ability.

The $M_2O/Al_2O_3$ molar ratio of the total raw materials used is preferably 0.2 or more, more preferably 1.5 or more, from the viewpoint of reaction rate. Also, the $M_2O/Al_2O_3$ molar ratio is preferably 8.0 or less, more preferably 4.0 or less, from the viewpoint of improving yield. In this case, M components are preferably Na, K, and the like, and Na is especially preferable.

The $MeO/Al_2O_3$ molar ratio of the total raw materials used is preferably 0 or more, more preferably 0.005 or more, especially preferably 0.01 or more, from the viewpoint of evening the distribution of the aggregate particle diameter. Also, the $MeO/Al_2O_3$ molar ratio is preferably 0.1 or less, more preferably 0.05 or less, still more preferably 0.03 or less, especially preferably 0.025 or less, from the viewpoint of improving the cationic exchange speed of the zeolite of the present invention.

A total concentration of the silica source, the aluminum source and the alkaline earth metal-containing compound in the slurry during the above reaction is preferably 10% by weight or more, especially preferably 15% by weight or more, from the viewpoint of productivity, as calculated on the basis of the solid ingredients of the weights of each of Si, M component, Al and Me component in the anhydride form, wherein the concentration of the solid ingredients in the entire water-containing slurry is defined as the reaction concentration. In addition, the total concentration is preferably 60% by weight or less, especially preferably 50% by weight or less, from the viewpoint of the flowability of the slurry and from the viewpoint of preventing excessive aggregation of the zeolite of the present invention.

The zeolite of the present invention can be obtained by mixing the starting composition as described above by the method described hereinbelow. Specifically, the reaction is carried out by mixing the raw materials such as the silica source and the aluminum source as main raw materials, and optionally in the existence of the alkaline earth metal-containing compound in a circulating line of a reaction vessel having a circulating system (circulating line) in its external part. The mixing is carried out in a mixer connected to the circulating line. As other raw materials, it is preferable that the reaction is carried out such that the alkaline earth metal-containing compound is previously mixed together with the silica source and/or the aluminum source as described above and fed to a circulating line as a substantially homogeneous mixture.

As the mixer connected to the above-mentioned circulating line includes, for instance, those mixers having an in-line rotary mixing mechanism such as homomic line mixers, homomic line mills, homogenizers, turbine pumps and centrifugal pumps are preferable. Among them, especially the homomic line mixers and the homomic line mills are preferably used because of their excellent mixing power. The mixing power of the mixer is not particularly limited, and it is preferable that the mixing is carried out such that the rotor and the turbine are rotated at a peripheral speed of preferably 11 m/s or more, more preferably 12 m/s or more, still more preferably 15 m/s or more. In addition, the agitation state of the slurry during mixing is preferably a mixed state of laminar flow and turbulent flow, namely a transitional state, and a mixed state of turbulent flow is more preferable. Concretely, the mixing Reynolds number is preferably 200 or more, more preferably 800 or more, still more preferably 1000 or more, especially preferably 4000 or more. Here, the mixing Reynolds number is determined on the basis of the following equation:

$$\mathrm{Re} = \frac{nd^2\rho}{\mu}$$

wherein d is a diameter (m) of an agitation impeller of a stirrer;

n is a rotational speed ($s^{-1}$);

ρ is a density ($kg/m^3$) of a slurry; and $\mu$ is a viscosity (Pa·s) of a slurry.

It is preferable that the reaction vessel comprises an agitation impeller so that the zeolite formed in the vessel would not be inhomogeneously aggregated. The zeolite is mixed such that the peripheral speed of the agitation impeller set in the reaction vessel is preferably 0.8 m/s or more, more preferably 2.0 m/s or more, especially preferably 2.5 m/s or more, from the viewpoint of forming a zeolite having an even distribution of the aggregate particle diameter. In addition, the agitation state of the slurry in the reaction vessel is preferably a mixed state of laminar air flow state and eddy flow state, namely a transitional state, and eddy flow state is more preferable. Concretely, the mixing Reynolds number is preferably 50 or more, more preferably 300 or more, still more preferably 500 or more, especially preferably 1000 or more.

In addition, the physical properties such as sizes, structures, and materials of the mixer, the reaction vessel and the agitation impeller are not particularly limited, as long as the zeolite of the present invention mentioned above can be efficiently prepared.

It is desired that the reaction temperature is usually from 25° to 100° C. The reaction temperature is preferably 25° C. or more, especially preferably 40° C. or more, from the viewpoint of the reaction rate. In addition, the reaction temperature is preferably 100° C. or less, especially preferably 70° C. or less, from the viewpoints of energy load and pressure tightness of the reaction vessel. The reaction time is preferably from 0 to 60 minutes, more preferably from 5 to 20 minutes, after the termination of the addition.

The above described is the reaction step for the silica source and the aluminum source. After the termination of this step, the reaction mixture is subjected to aging process, thereby accelerating crystallization, to give the zeolite of the present invention. The aging temperature during this step is, for instance, preferably 50° C. or more, more preferably 80° C. or more, from the viewpoint of the crystallization rate. Also, the aging temperature is preferably 100° C. or less, from the viewpoints of energy load and pressure tightness of the reaction vessel. The aging time is usually, for instance, preferably from 1 to 300 minutes, from the viewpoint of productivity. In the aging step, it is preferable that aging is carried out until the most intensive peak intensity of the X-ray diffraction patterns attains to its maximum, or the cationic exchange capacity of the zeolite attains to its maximum.

In the above-mentioned aging step, the zeolite is crystallized. However, during this step, when the homogeneity of the slurry in the system is impaired, crystals are undesirably randomly aggregated with each other. Therefore, it is preferable that the slurry always maintains a homogeneous mixing state. For this reason, it is preferable that the reaction vessel is continuously stirred even during aging, with rotating the mixer continuously. In addition, as to the circulation flow rate of the circulating line, the zeolite is mixed such that the linear speed of the slurry circulated in the circulating line is preferably 0.7 m/s or more, more preferably 1.0 m/s or more, especially preferably 1.5 m/s or more, from the viewpoint of forming a zeolite having an even distribution of the aggregate particle diameter.

After the termination of aging, the resulting slurry is filtered and washed, or neutralized with an acid to terminate the crystallization. In the case where the slurry is filtered and washed, it is preferable that washing is carried out until the pH of the washing liquid attains to 12 or less. Alternatively, in the case where the slurry is neutralized, the acid used includes, for instance, sulfuric acid, hydrochloric acid, nitric acid, carbon dioxide gas, oxalic acid, citric acid, tartaric acid, fumaric acid, and the like. Among them, sulfuric acid and carbon dioxide gas are preferable, from the viewpoints of the corrosion of the apparatus and costs. In this case, it is preferable to adjust the pH of the slurry after neutralization to 7 to 12.

According to the embodiment (3) described above, there is obtained the zeolite of the present invention of which anhydride form has a composition represented by $xM_2O.ySiO_2.Al_2O_3.zMeO$, wherein M is an alkali metal atom, Me is an alkaline earth metal atom, x is from 0.5 to 1.5, y is from 0.5 to 6, and z is from 0 to 0.1.

This mixing is a technique of obtaining the zeolite of the present invention by vigorously stirring in the reaction step and the aging step in the preparation of the zeolite. Specifically, this technique is intended to prevent an uneven distribution of the aggregate particle diameter of the finally obtained zeolite due to uneven collision and aggregation of the zeolite precursor formed during the reaction step or the crystals of the zeolite formed during the aging step. As such a process, it is most preferable to use a reaction vessel comprising a circulating line and a mixer. However, such a reaction vessel is not necessarily employed as long as it is a means which would avoid uneven collision of the zeolite precursor or the crystals of the zeolite. In other words, as the component (A) of the present invention, preferred examples are those zeolites prepared by mixing the aluminum source and/or the silica source in the presence of the alkaline earth metal-containing compound.

In addition, the zeolite obtained by the process of mixing under the embodiment (3) described above is subjected to a post-treatment, i.e. pulverization of the embodiment (1) and/or classification the embodiment (2) mentioned above, whereby a zeolite having a more even distribution of the aggregate particle diameter can be obtained.

The zeolite of the present invention obtained in each of the embodiments (1) to (3) described above has a primary particle diameter of preferably 2 μm or less, more preferably 1.3 μm or less, still more preferably 1 μm or less, especially preferably 0.8 μm or less, as determined by the method described in Item (1-1) of Examples set forth below, from the viewpoint of improving the cationic exchange ability. As to the cationic exchange ability of the zeolite of the present invention, since the distribution of the aggregate particle diameter is even, the adhesion between the particles in water becomes small, and the dispersibility in water becomes high, so that the cationic exchange ability (especially the 1-minute cationic exchange ability) becomes consequently high.

The zeolite of the present invention has a 1-minute cationic exchange ability of preferably 120 mg $CaCO_3$/g or more, more preferably 150 mg $CaCO_3$/g or more, especially preferably 170 mg $CaCO_3$/g or more, as determined by the method described under Item (1-3) of Examples set forth below.

Also, the zeolite of the present invention has a 10-minute cationic exchange ability of preferably 190 mg $CaCO_3$/g or more, more preferably 200 mg $CaCO_3$/g or more, especially preferably 210 mg $CaCO_3$/g or more, as determined by the method described under Item (1-3) of Examples set forth below.

In addition, the zeolite of the present invention exhibits an excellent oil-absorbing ability because the primary particles are homogeneously gathered together to form an aggregate. This oil-absorbing ability is effective for increasing the supporting ability of the surfactant of the base particles. Therefore, the above-mentioned zeolite of the present invention can be favorably added to a laundry detergent.

The zeolite of the present invention has an oil-absorbing ability of preferably 80 mL/100 g or more, more preferably 100 mL/100 g or more, especially preferably 150 mL/100 g or more, as determined by the method according to JIS K 5101, from the viewpoint of improving the oil-absorbing ability of the base particles.

The content of the zeolite of the present invention in the base particles is preferably 1% by weight or more, more preferably 5% by weight or more, especially preferably 10% by weight or more, from the viewpoint of the detergency, and the content of the zeolite is preferably 90% by weight or less, more preferably 80% by weight or less, especially preferably 70% by weight or less, from the viewpoint of the particle strength of the base particle.

(B) Water-Soluble Polymer

The term "water-soluble polymer" refers to an organic polymer of which solubility is 0.5 g or more to 100 g of water at 25° C., and molecular weight is 1000 or more. The water-soluble polymer is not particularly limited, as long as it has an effect of improving detergency and/or an effect of improving the particle strength of the base particle. For instance, one or more members selected from the group consisting of carboxylic acid-based polymers; cellulose derivatives such as carboxymethyl celluloses; aminocarboxylic acid-based polymers such as polyglyoxylates and polyasparatates; water-soluble starches; and sugars can be exemplified as preferred examples. Among them, the carboxylic acid-based polymers are preferable, from the viewpoint of the detergency.

The content of the water-soluble polymer in the base particle is preferably from 2 to 25% by weight, more preferably from 3 to 20% by weight, most preferably from 4 to 15% by weight, within which range the particle strength of the resulting base particles becomes sufficiently high, making it preferable from the viewpoint of the dissolubility of the detergent composition.

(C) Water-Soluble Salt

The water-soluble salt includes carbonates, hydrogencarbonates, sulfates, sulfites, hydrogensulfites, phosphates, chlorides, bromides, iodides, fluorides, and the like, which include water-soluble inorganic salts of which bases are alkali metals, ammonium, amines, and the like; and low-molecular weight water-soluble organic acid salts such as citrates and fumarates. Among them, carbonates, sulfates, sulfites and chlorides are preferable. These water-soluble salts can be constituted by a single component or a plural components, or a double salt composed of a plural components may be formed.

In addition, it is effective to admix anions different from carbonate ions, such as sulfate ions or sulfite ions, or cations different from sodium ions such as potassium ions or ammonium ions in the base particles, from the viewpoint of avoidance of the formation of a paste in water. Concretely, the compounds containing the anions and the cations mentioned above may be added to the base particles.

The content of the water-soluble salt in the base particles is preferably from 5 to 75% by weight, more preferably from 10 to 70% by weight, most preferably from 20 to 60% by weight, within which range the particle strength of the resulting base particles becomes sufficiently high, making it preferable from the viewpoint of the dissolubility of the detergent particles.

(D) Surfactant

As the surfactant, for instance, an anionic surfactant can be suitably used. The anionic surfactant can be, for instance, known anionic surfactants disclosed in "Chapter 3, Section 1 of *Shuchi•Kanyo Gijutsushu* (*Iryoyo Funmatsusenzai*) [Known and Well Used Technical Terminologies (Laundry Powder Detergent)]" a publication made by the Japanese Patent Office.

The content of the surfactant in the base particles of the present invention is preferably from 0 to 5% by weight. When detergent particles are prepared by a process comprising absorbing a surfactant solution into base particles, it is preferable that a surfactant is not substantially contained, from the viewpoint of improving an ability of absorbing a surfactant (oil-absorbing ability) of the base particles. By using the zeolite of the present invention in the base particles not substantially containing a surfactant described above, there is an effect of dramatically improving the cationic exchange ability of the base particles.

(E) Other Components

Besides the components (A) to (D) described above, to the base particles, a zeolite such as a commercially available zeolite can be added in an amount so that the cationic exchange ability of the base particles would not be impaired. Here, the phrase "an amount so that the cationic exchange ability of the base particles would not be impaired" means that the base particles described below would not have cationic exchange ability outside the range specified herein. In addition, the base particles can contain auxiliary components such as fluorescers, pigments and dyes in an amount of 1% by weight or less.

The base particles of the present invention are prepared by spray-drying a slurry, preferably an aqueous slurry, comprising a zeolite (A) having an average aggregate particle diameter of 15 μm or less and a variation coefficient of a distribution of an aggregate particle diameter of 29% or less, a water-soluble polymer (B), a water-soluble salt (C), and optionally a surfactant (D) so as to give base particles comprising:

1 to 90% by weight of the zeolite (A);

2 to 25% by weight of the water-soluble polymer (B);

5 to 75% by weight of the water-soluble salt (C); and optionally 0 to 5% by weight of the surfactant (D).

In a preferred embodiment, the slurry comprises 0.5 to 70% by weight of the zeolite (A); 1 to 20% by weight of the water-soluble polymer (B); 1 to 60% by weight of the water-soluble salt (C); and optionally 0 to 5% by weight of the surfactant (D).

In the above-mentioned slurry to be spray-dried, the content of the above-mentioned component (A) is preferably from 0.5 to 70% by weight, more preferably from 1 to 50% by weight; the content of the above-mentioned component (B) is preferably from 1 to 20% by weight, more preferably from 2 to 15% by weight; the content of the above-mentioned component (C) is preferably from 1 to 60% by weight, more preferably from 2 to 50% by weight; the content of the above-mentioned component (D) is preferably 5% by weight or less, more preferably from 0 to 4% by weight, still more preferably from 0 to 3% by weight; and the content of the above-mentioned component (E) is preferably from 0 to 70% by weight, more preferably from 0 to 60% by weight. It is preferable that the balance of the slurry is water. The slurry can be prepared by adding the above-mentioned components (A) to (D), and optionally the component (E) to water and mixing the components. In addition, a process for spray-drying the slurry can be a known process.

The water content of the base particles obtained as described above is preferably 8% by weight or less, more preferably 5% by weight or less, especially preferably 3% by weight or less, as determined by an infrared moisture meter (measurement conditions: 105° C. for 2 hours), from the viewpoint of the cationic exchange ability of the base particles.

Here, the water generally present in the base particles obtained by spray-drying causes liquid bridging between the aggregate particles of the zeolite in the base particle. Therefore, the aggregate particles are adhered to each other due to its liquid bridging strength, so that the dispersibility of the zeolite in water is lowered, whereby the cationic exchange ability of the zeolite alone would not directly reflect the cationic exchange ability of the base particles. As a means for preventing the lowering of the dispersibility of the zeolite due to cross-linking in a liquid state, it is effective to add the zeolite of the present invention to a raw material slurry of the base particles. The adhesive strength between two particles caused by cross-linking in a liquid state affects a ratio of radii of the two particles: The larger the ratio of the radii, i.e. the larger the difference in particle diameters of the two particles, the stronger the cross-linking strength in a liquid state. In other words, the cross-linking strength in a liquid state attains to its minimum when the two particles have the same level of size, i.e. a distribution of the particle diameter is even. Therefore, the base particles containing the zeolite of the present invention have a small cross-linking strength in a liquid state due to residual water contained therein. Consequently, the zeolite in the base particles is readily dispersed in water to rapidly exhibit the cationic exchange ability owned by the zeolite, so that the base particles exhibit a high cationic exchange ability.

The cationic exchange ability of the base particles is evaluated as Ca ion exchange capacity (detailed determination method being given in Item (2-1) of Examples set forth below) when base particles dried at 160° C. for 1 hour are added to an aqueous calcium chloride solution at 10° C. having a concentration of 100 ppm calculated as $CaCO_3$ so as to have a concentration of 0.35 g/L, and the solution is subjected to cation exchanging for 3 minutes or 10 minutes. The base particles have a 3-minute cationic exchange ability of preferably 140 mg $CaCO_3$/g or more, more preferably 145 mg $CaCO_3$/g or more, still more preferably 150 mg $CaCO_3$/g or more, especially preferably 160 mg $CaCO_3$/g or more, as determined by the determination method described in Item (2-1) of Examples set forth below, from the viewpoint of the detergency.

The base particles have a 10-minute cationic exchange ability of preferably 190 mg $CaCO_3$/g or more, more preferably 195 mg $CaCO_3$/g or more, especially preferably 200 mg $CaCO_3$/g or more, as determined by the determination method described in Item (2-1) of Examples set forth below, from the viewpoint of the detergency.

As described above, the base particles have high cationic exchange ability, so that the powdery detergent (detergent particles) containing the base particles exhibits high detergency.

(II) Detergent Particles

The term "detergent particle" of the present invention refers to a particle comprising the base particle of the present invention and optionally a surfactant, a detergent builder and the like, and the term "detergent particles" means an aggregate thereof. The detergent particles of the present invention can take any embodiments of uni-core detergent particles and multi-core detergent particles, and the uni-core detergent particles are preferable. The term "uni-core detergent particle" refers to a detergent particle which is prepared by supporting a surfactant to the base particle, wherein a single detergent particle has one base particle as a core. In addition, the term "multi-core detergent particle" refers to a detergent particle having several base particles as cores in a single detergent particle. Here, it is preferable that the detergent particles are prepared by supporting 1 to 100 parts by weight of a surfactant, based on 100 parts by weight of the base particles of the present invention, and that the resulting detergent particles have an average particle diameter of from 150 to 750 $\mu$m, and a bulk density of 500 g/L or more.

It is preferable that the surfactant to be used for a detergent includes, for instance, anionic surfactants and nonionic surfactants. Each of the anionic surfactants and the nonionic surfactants can be used alone, and it is more preferable that the anionic surfactant and the nonionic surfactant are used in admixture. In addition, amphoteric surfactants and cationic surfactants can be used together with those anionic surfactants and nonionic surfactants in accordance with its purpose. In addition, when an anionic surfactant such as an alkylbenzenesulfonate is added to the detergent particles in an amount of 5 to 25% by weight, there is exhibited an effect of avoidance of the formation of a paste in water.

The above surfactants (anionic surfactants, nonionic surfactants, amphoteric surfactants and cationic surfactants), for instance, those known surfactants disclosed in "Chapter 3, Section 1 of *Shuchi•Kanyo Gijutsushu* (*Iryoyo Funmatsusenzai*) [Known and Well Used Technical Terminologies (Laundry Powder Detergent)]" a publication made by the Japanese Patent Office.

In addition, for instance, when the above-mentioned anionic surfactant is added to the detergent particle, there can be employed a process of adding the anionic surfactant in an acidic form, and separately adding an alkali thereto.

The detergent particles of the present invention may contain a water-soluble organic solvent in the above surfactant as a viscosity-controlling agent. As the water-soluble organic solvent, for instance, polyethylene glycols and the like can be preferably used.

The formulation ratio of the water-soluble organic solvent is preferably from 1 to 50 parts by weight, more preferably from 5 to 30 parts by weight, based on 100 parts by weight of the surfactant, within which range the viscosity of the surfactant is appropriate such that the water-soluble organic solvent is easily absorbed in the base particle, but not likely to bleed out.

The above-mentioned detergent builder means a powdery detergency enhancer other than the surfactants. Concrete examples thereof include base materials having cationic exchange ability such as zeolites (including the zeolite of the present invention), amorphous aluminosilicates and citrates; base materials exhibiting alkalizing ability such as sodium carbonate and potassium carbonate; base materials having both cationic exchange ability and alkalizing ability such as crystalline alkali metal silicates; other base materials for enhancing ionic strength such as sodium sulfate; and the like.

The amount of the detergent builder used is preferably from 0.5 to 12 parts by weight, more preferably from 1 to 8 parts by weight, based on 100 parts by weight of the base particles, within which range it is preferable from the viewpoint of increasing the free flowability of the detergent particle and having excellent anti-caking property during storage.

As the process for preparing detergent particles, there can be employed a known process. Such a process includes, for instance, the process comprising blowing a surfactant into the above-mentioned base particles, and optionally further adding a detergent builder thereto.

EXAMPLES

Found values in Examples and Comparative Examples were measured by the following methods.

(1) Evaluation Methods for Zeolite (1-1) Primary Particle Diameter

Figure 2:
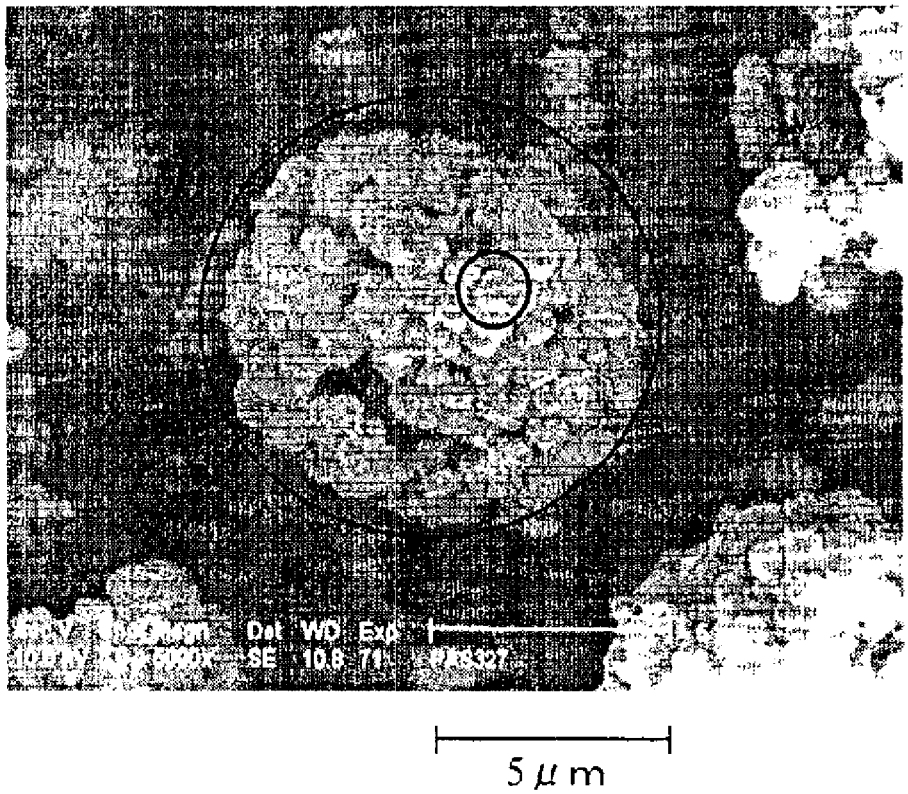
FIG. 2 is a SEM image photograph at a magnification of 5000 expanding a part circumscribed with a rectangular frame in FIG. 1, showing an aggregate particle (circumscribed with a large circle) comprising an aggregate of primary particles (circumscribed with a small size)

The longest width of each of 50 or more particles, each being confirmed to be a single particle (region encircled by a smaller circle in FIG. 2), based on an SEM image of zeolite photographed at a magnification of 5000 by a scanning electron microscope (commercially available from Shimadzu Corporation, SUPERSCAN-220, hereinafter the same) was measured by using a digitizer (commercially available from GRAPHTEC CORPORATION, "DIGITIZER KW3300," hereinafter the same). The average value of the found values obtained was defined as a primary particle diameter.

(1-2) Average Aggregate Particle Diameter and Variation Coefficient of Distribution of Aggregate Particle Diameter In an SEM image (for instance, FIG. 1) of the zeolite photographed at a magnification of 1000 using a scanning electron microscope, an aggregate of primary particles (region encircled by a larger circle in FIG. 2) was defined as aggregated particles, and the largest diameter of the aggregated particles was measured by the digitizer. The number-based average value of the particle diameters of 50 or more aggregated particles obtained was defined as an average aggregate particle diameter (D). In addition, the standard deviation (σ) was calculated from the distribution of the particle diameter of the aggregated particles, and the value calculated from the expression:

Standard Deviation (σ)+Average Aggregate Particle Diameter ($D$)×100 was defined as variation coefficient (unit: %).

(1-3) Cationic Exchange Capacity of Zeolite

One-hundred milliliters of an aqueous calcium chloride (100 ppm, when calculated as $CaCO_3$) at 10° C. is added to a 100 mL beaker, and stirred at a rotational speed of 400 r/min with a stirrer piece of 30 mm×8 mm. Next, a sample is accurately weighed (0.04 g in a case where the zeolite is a powder, and 0.04 g of zeolite calculated on a solid basis in a case where the zeolite is in an aqueous slurry state), and supplied to the aqueous calcium chloride under stirring. After stirring the mixture at 10° C. for a given time period (1 minute or 10 minutes), the mixture is filtered with a membrane filter with 0.2 μm pore size. Ten milliliters of the filtrate is taken and assayed for Ca content in the filtrate by an EDTA titration, and the amount of Ca (when calculated as $CaCO_3$) ion-exchanged by 1 g of the sample after 1 minute or 10 minutes is calculated by the following equation, and defined as cationic exchange capacity of zeolite after 1 minute or 10 minutes.

Cationic exchange capacity of zeolite after 1 minute or 10 minutes=$((B-V)\times M\times 100.09\times 100/10)/S$ wherein:

B: EDTA titer (mL) for the blank (calcium chloride solution (100 ppm, when calculated as $CaCO_3$))

V: EDTA titer for a sample solution (mL)

M: Molar concentration of EDTA (mol/L)

100.09: Molecular weight of $CaCO_3$ (g)

100: Amount of the calcium chloride solution used for the measurement (mL)

10: Amount of a solution to be titrated (mL)

S: Amount of zeolite powder (g)

(2) Evaluation Method for Base Particles (2-1) Cationic Exchange Capacity of Base Particles Three grams of the base particles are weighed on a glass petri dish, and dried in a drier at 160° C. for 1 hour. A 0.35 g portion of the base particles is accurately weighed, and added to 1000 mL of an aqueous calcium chloride solution (100 ppm, when calculated as $CaCO_3$) at 10° C. The resulting mixture is stirred at 400 r/min at a constant temperature of 10° C. for 3 minutes or 10 minutes, and thereafter filtered with a filter having 0.2 μm pore size. Ten milliliters of the filtrate is assayed for Ca content by an EDTA titration, and the amount of Ca (when calculated as $CaCO_3$) ion-exchanged by 1 g of the zeolite in the base particles after 3 minutes or 10 minutes calculated by the following equation is defined as the cationic exchange capacity of the base particles after 3 minutes or 10 minutes.

Cationic exchange capacity of base particles after 3 minutes or 10 minutes=$((B-V)\times M\times 100.09\times 1000/10)/S$ wherein:

B: EDTA titer (mL) for the blank (calcium chloride solution (100 ppm, when calculated as $CaCO_3$))

V: EDTA titer for a sample solution (mL)

M: Molar concentration of EDTA (mol/L)

100.09: Molecular weight of $CaCO_3$ (g)

1000: Amount of the calcium chloride solution used for the measurement (mL)

10: Amount of a solution to be titrated (mL)

S: Amount of the zeolite contained in the base particles (g)

(3) Evaluation Method for Detergent Particles (Detergency)

Preparation of Artificially Soiled Cloth

An artificial soil solution having the following composition was smeared to a cloth to prepare an artificially soiled cloth. The smearing of the artificial soil solution to a cloth was carried out by printing the artificial soil solution on a cloth using a gravure roll coater in accordance with Japanese Patent Laid-Open No. Hei 7-270395. The process for smearing the artificial soil solution to a cloth to prepare an artificially soiled cloth was carried out under the conditions of a cell capacity of a gravure roll of 58 $cm^3/cm^2$, a coating speed of 1.0 m/min, a drying temperature of 100° C., and a drying time of one minute. As to the cloth, #2003 calico (commercially available from Tanigashira Shoten) was used.

(Composition of Artificial Soil Solution) (Here, "%" Represents "% by Weight.")

Lauric acid: 0.44%, myristic acid: 3.09%, pentadecanoic acid: 2.31%, palmitic acid: 6.18%, heptadecanoic acid: 0.44%, stearic acid: 1.57%, oleic acid: 7.75%, triolein: 13.06%, n-hexadecyl palmitate: 2.18%, squalene: 6.53%, liquid crystalline product of lecithin, from egg yolk: 1.94%, Kanuma red clay: 8.11%, carbon black: 0.01%, and tap water: balance.

(Washing Conditions and Evaluation Method)

Twenty-two grams of detergent particles used for the evaluation were weighed. Next, 2.2 kg of clothes (cotton underwear) were prepared. Next, 10 pieces of the artificially soiled clothes of 10 cm×10 cm, which were prepared as above, were sewn onto 3 pieces of cotton support clothes of 35 cm×30 cm, and placed in a washing machine "AISAIGO NA-F70AP" commercially available from Matsushita Electric Industrial Co., Ltd., together with the previously prepared clothes. The weighed detergent particles were added thereto, and washing was carried out. The washing conditions are as follows.

Washing course: standard course; concentration of detergent: 0.067%; water hardness: 4° DH; water temperature: 20° C.; and liquor ratio: water/clothes=(15/1).

The detergency was determined by measuring the reflectances at 550 nm of the unsoiled cloth and the soiled cloth before and after washing by an automatic recording colorimeter (commercially available from Shimadzu Corporation). The deterging rate (%) was determined by the following equation, and the detergency was expressed as an average determination value of the deterging rates for the 10 pieces.

$$\text{Deterging Rate (\%)} = \frac{\text{Reflectance of Soiled Clothes After Washing} - \text{Reflectance of Soiled Clothes Before Washing}}{\text{Reflectance of Unsoiled Cloth} - \text{Reflectance of Soiled Clothes Before Washing}} \times 100$$

Example 1

Figure 3:
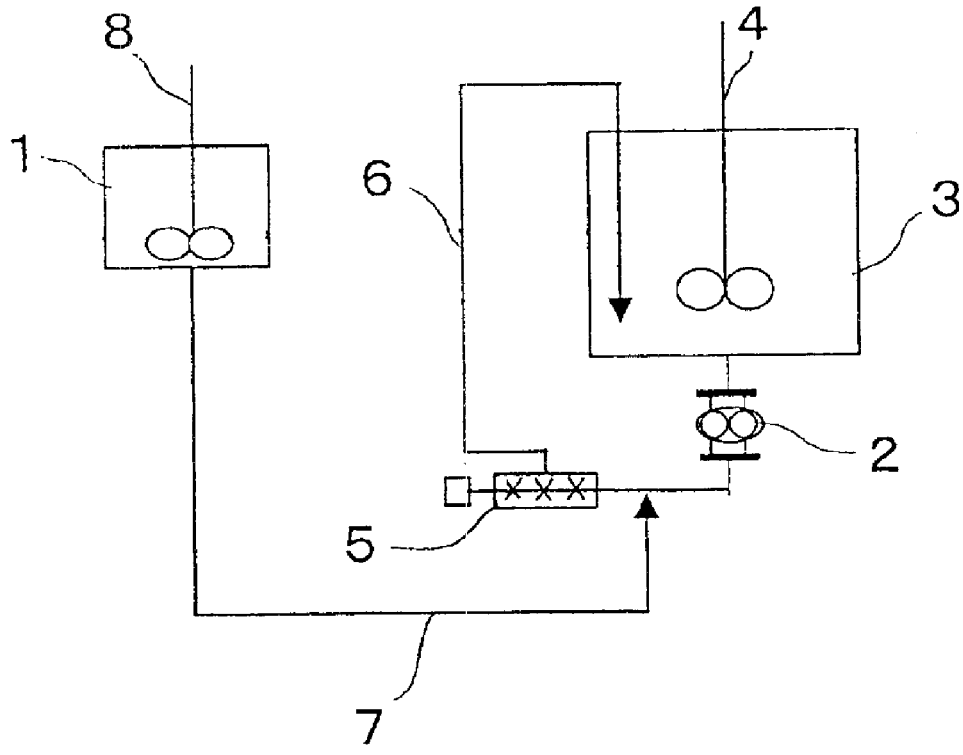
FIG. 3 is a schematic explanatory view showing an apparatus for preparing the zeolite of the present invention with stirring, wherein 1 is a raw material vessel, 2 a liquid conveying pump, 3 a reaction vessel, 4 a stirrer, 5 a mixer, 6 a circulating line, 7 a raw material feeding line and 8 an agitation impeller.

Zeolite was prepared by the following method, using a mixer-synthesizer schematically shown in FIG. 3, which comprises a reaction tank 3 (350-L stainless tank) equipped with an external circulating line 6 having a mixer 5. In the mixer-synthesizer, a liquid can be conveyed to the circulating line 6 with a liquid-conveying pump 2 (commercially available from DAIDO METAL CO. LTD., WP pump, Model: WP3WL140C0) from the bottom of the reaction tank 3, and raw materials can be fed to a position immediately before the inlet of the mixer 5 (line mixer; commercially available from Tokushu Kika Kogyo Co. Ltd., Model: 2S6) via a raw material feed line 7 from a raw material tank 1 (200-L stainless tank).

The amount 105.6 kg of an aqueous solution of No. 3 water glass ($Na_2O$: 9.68% by weight, $SiO_2$: 29.83% by weight) was placed in the raw material tank 1, and stirred at a stirring rate of 100 rpm with agitation impellers 8 having a length of 210 mm. Then, 28.3 kg of a 48% by weight aqueous sodium hydroxide was supplied to the tank, and 72.2 kg of a 0.81% by weight aqueous calcium chloride was further supplied thereto. The resulting mixture was heated to 50° C. Next, 95.0 kg of an aqueous sodium aluminate ($Na_2O$: 21.01% by weight, $Al_2O_3$: 28.18% by weight) was supplied to a reaction tank 3, and heated to 50° C., with stirring at a stirring rate of 100 rpm with an agitator 4 comprising one each of a pitch paddle (not shown in the figure) and an anchor paddle (not shown in the figure), each having a length of 500 mm. While the aqueous sodium aluminate was circulated in advance to the circulating line 6 at a flow rate of 40 kg/min (linear velocity of the circulating line: 0.35 m/s) with the liquid-conveying pump 2, with operating the agitator 4, the reaction was initiated by setting the rotational speed of the mixer 5 at 3600 rpm (peripheral speed of the turbine: 16 m/s), and feeding the solution in the raw material tank 1 into the circulating line 6 via the raw material feed line 7. After the termination of the reaction (after the addition of the entire raw material in the raw material tank 1), the raw material had a compositional ratio such that an $SiO_2/Al_2O_3$ molar ratio was 2, that an $Na_2O/Al_2O_3$ molar ratio was 2.5, and that $CaO/Al_2O_3$ molar ratio was 0.02. The liquid-conveying pump 2 was adjusted so that the circulation flow rate was 130 kg/min (linear velocity of the circulating line: 1.5 m/s). The temperature was raised to 80° C., while the slurry obtained by the reaction was circulated, and the mixture was aged for 60 minutes with keeping the temperature at 80° C.

The resulting slurry was taken out of the above mixer-synthesizer, filtered and washed until the pH of the filtrate attained to 11.4. The resulting residue was dried at 100° C. for 13 hours, to give a zeolite powder.

X-ray diffraction patterns of the resulting zeolite were measured using an X-ray diffractometer (commercially available from K.K. Rigaku, Model: RINT2500VPC) under the conditions of CuK α-ray, 40 kV, and 120 mA. The zeolite was qualitatively evaluated based on the diffraction patterns presented in JCPDS. As a result, the zeolite was found to be zeolite 4A-type. The resulting zeolite had a composition of 1.02 $Na_2O$.2.05 $SiO_2$.$Al_2O_3$.0.02 CaO.

Figure 4:
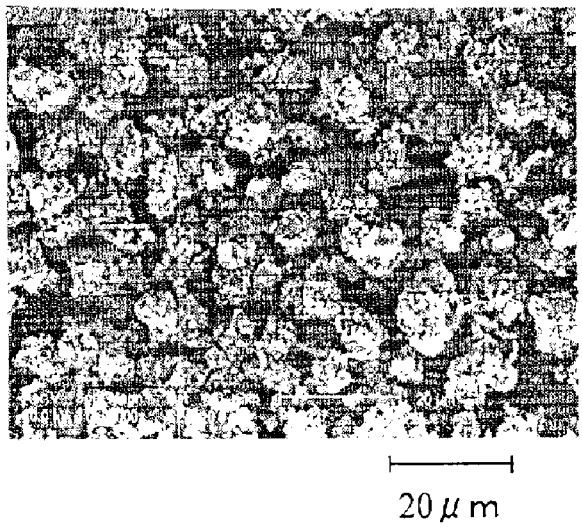
FIG. 4(*a*) is a SEM image photographed at a magnification of 1000 of zeolite obtained in Example 1.
Figure 4:
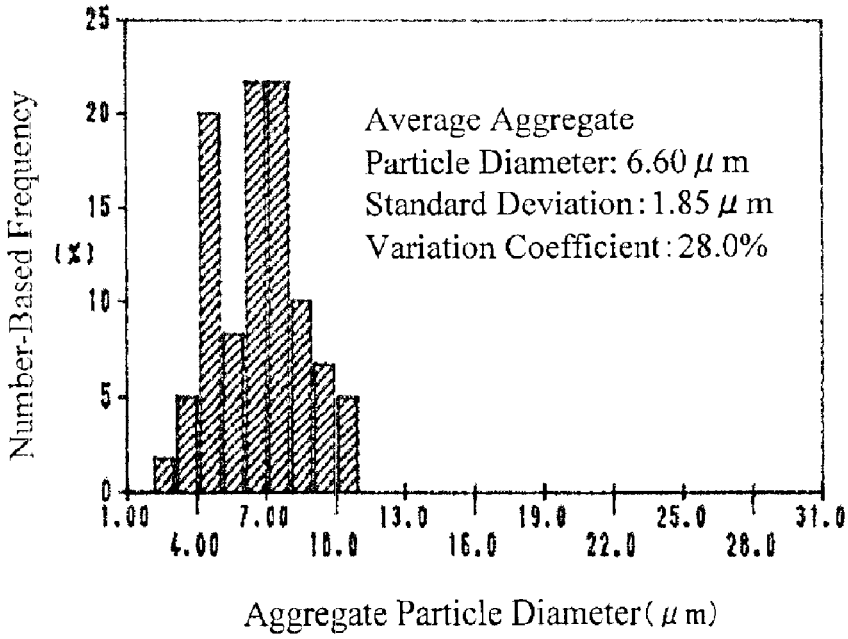

In addition, an SEM image of the resulting zeolite powder was photographed at a magnification of 1000 using an SEM (FIG. 4(*a*)). The distribution of the aggregate particle diameter determined based on FIG. 4(*a*) using the digitizer is shown in FIG. 4(*b*). The properties of the resulting zeolite are shown in Table 1.

Example 2

Figure 5:
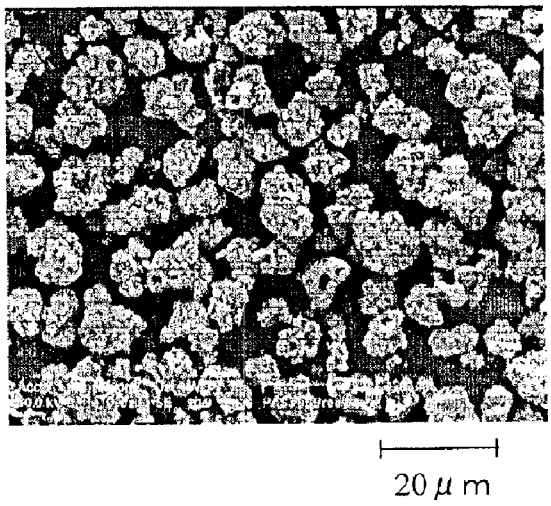
FIG. 5(*a*) is a SEM image photographed at a magnification of 1000 of zeolite obtained in Example 2.
Figure 5:
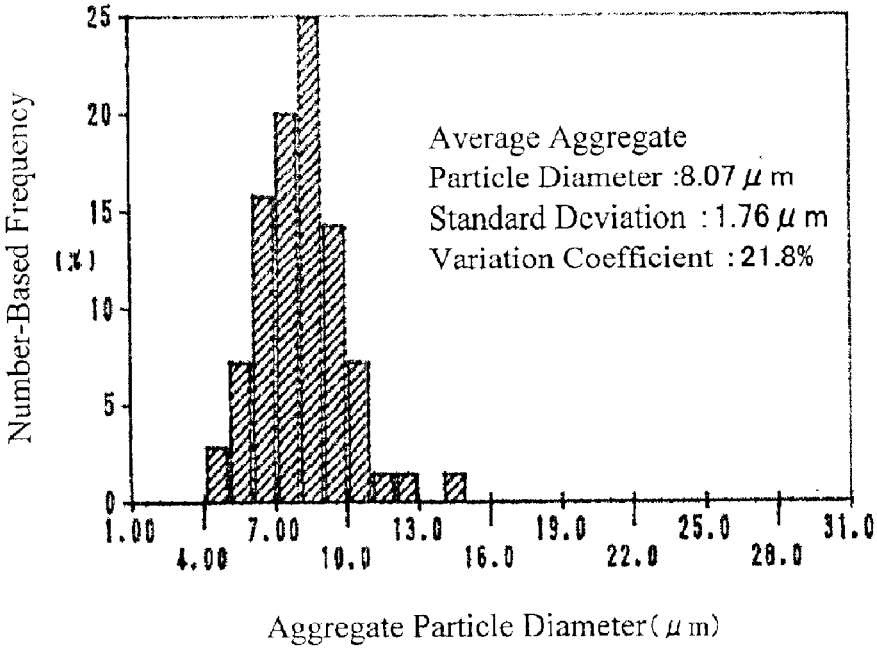

The zeolite obtained in Example 1 was classified by the following method. Thirty-five kilograms of an aqueous solution containing the zeolite at a concentration of 20% by weight was placed in a cylindrical stainless container (inner diameter: 400 mm, height: 300 mm). The zeolite was homogeneously stirred and dispersed, and thereafter the solution was allowed to stand at 20° C. for 12 hours. As a result, precipitates in a volume with a height of 70 mm from the bottom, and supernatant in a volume with a height of 230 mm in the container were obtained. After removing the supernatant by decantation, the zeolite precipitation was obtained. A 100 g portion of the obtained zeolite was placed in a 500-mL beaker, and dried at 100° C. for 13 hours. An SEM image of the resulting zeolite powder was photographed at a magnification of 1000 using the SEM (FIG. 5(*a*)). The distribution of the aggregate particle diameter determined based on FIG. 5(*a*) using the digitizer is shown in FIG. 5(*a*). The properties of the resulting zeolite are shown in Table 1.

Example 3

Figure 6:
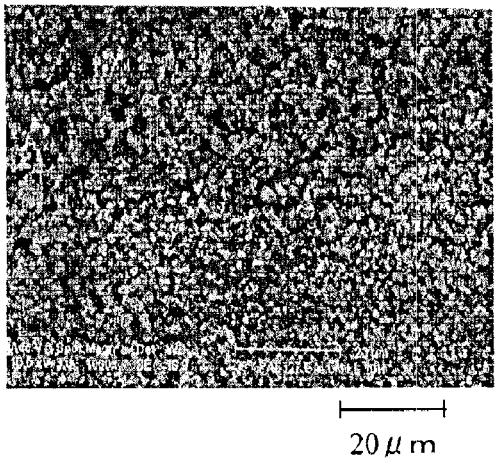
FIG. 6(*a*) is a SEM image photographed at a magnification of 1000 of zeolite obtained in Example 3.
Figure 6:
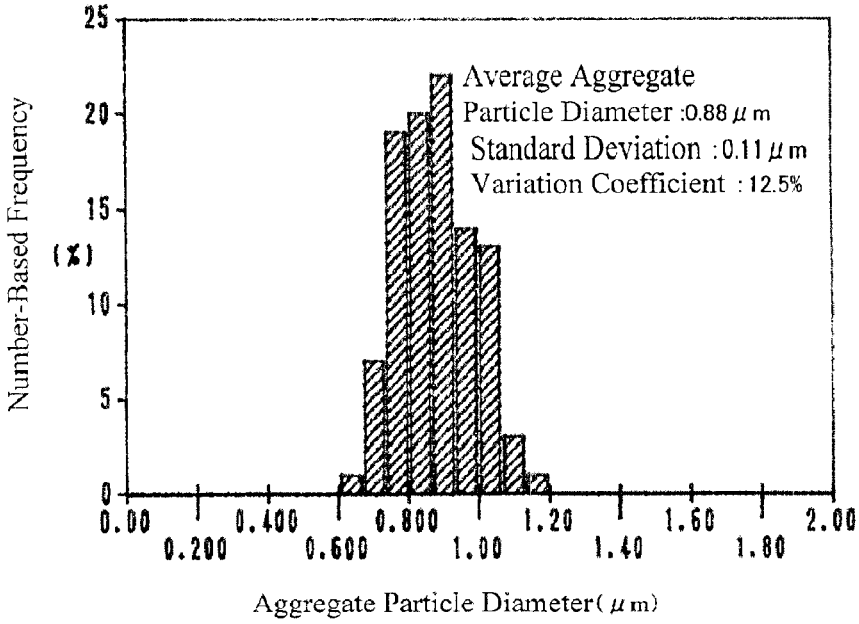

The zeolite obtained in Example 1 was pulverized by the following method. Five-hundred grams of an aqueous solution containing the zeolite at a concentration of 40% by weight was placed in a 1-L polystyrene sealed container together with 2000 g of zirconia ball having a diameter of 5 mm. Pulverization was carried out in a ball-mill (300 rpm) for 12 hours, and a 100 g portion of the resulting slurry was placed in a 500-mL beaker and dried at 100° C. for 13 hours. An SEM image of the resulting zeolite powder was photographed at a magnification of 1000 using an SEM (FIG. 6(*a*)). The distribution of the aggregate particle diameter determined based on FIG. 6(*a*) using the digitizer is shown in FIG. 6(*b*). The properties of the resulting zeolite are shown in Table 1.

Comparative Example 1

Figure 7:
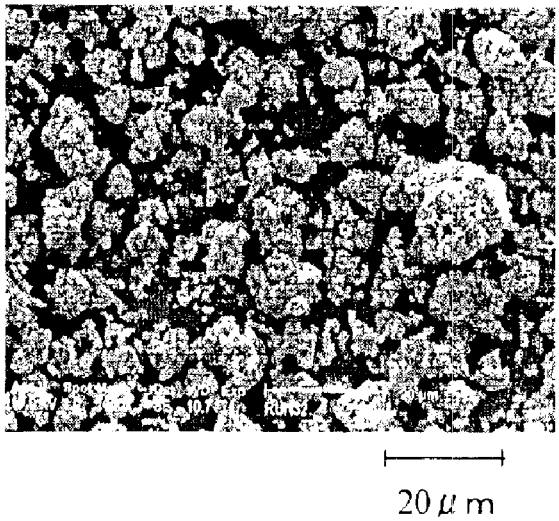
FIG. 7(*a*) is a SEM image photographed at a magnification of 1000 of zeolite used in Comparative Example 1.
Figure 7:
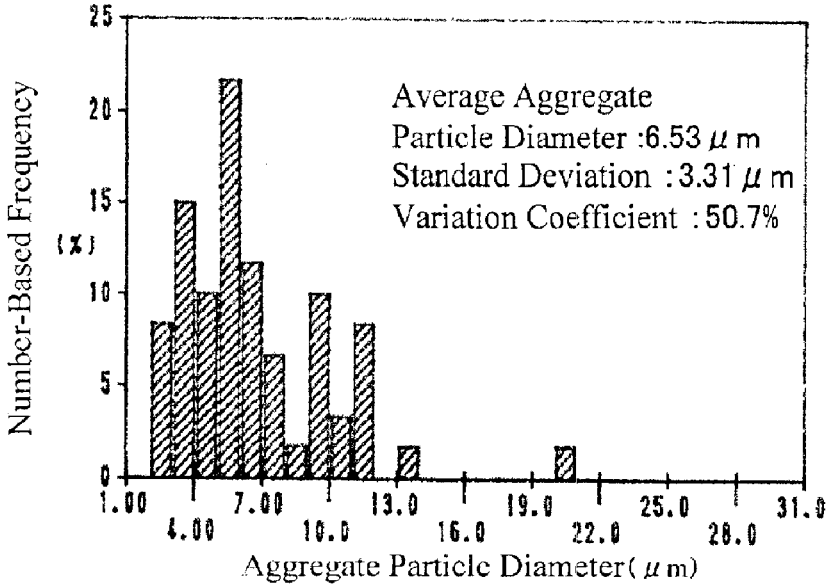

Zeolite 4A-type was prepared in the same manner as in Example 1, using the same reactor of Example 1, except that the rotational speed of the mixer 5 was reduced from 3600 rpm to 2400 rpm (peripheral speed of the turbine: 10.7 m/s), and the circulation flow rate in the aging step after the reaction was changed from 130 kg/min in Example 1 to 54.5 kg/min (linear velocity of the circulating line: 0.64 m/s). An SEM image of the resulting powder was photographed using an SEM (FIG. 7(*a*)). The distribution of the aggregate particle diameter determined based on FIG. 7(*a*) using the digitizer is shown in FIG. 7(*b*). The properties of the resulting zeolite are shown in Table 1.

Comparative Example 2

Figure 8:
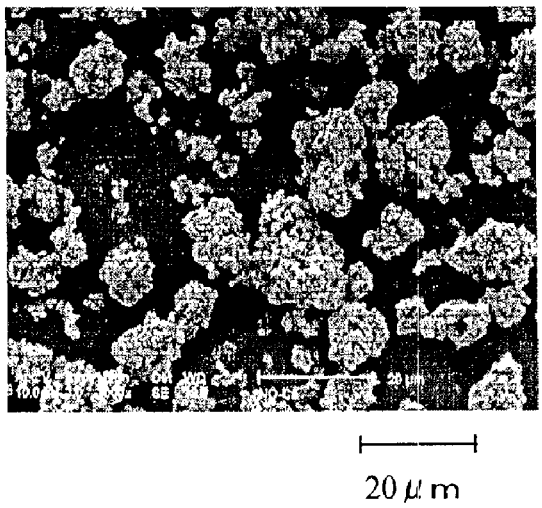
FIG. 8(*a*) is a SEM image photographed at a magnification of 1000 of zeolite used in Comparative Example 2.
Figure 8:
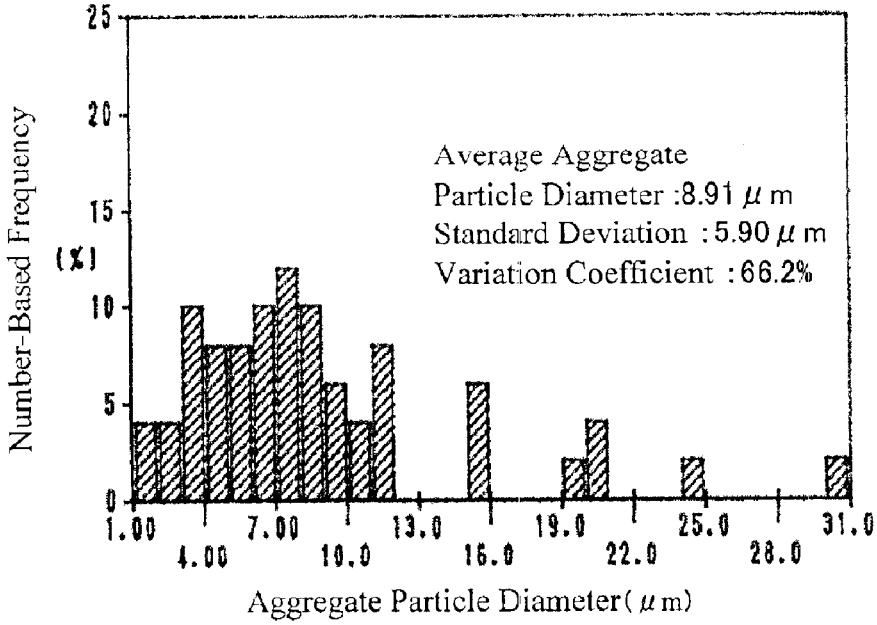

Zeolite 4A-type was prepared in the same manner as in Comparative Example 1 except that 71.7 kg of ion-exchanged water was used in place of 72.2 kg of a 0.81% by weight aqueous calcium chloride solution of the raw materials used in Comparative Example 1. An SEM image of the resulting powder of zeolite 4A-type was photographed at a magnification of 1000 using an SEM (FIG. 8(*a*)). The distribution of the aggregate particle diameter determined based on FIG. 8(*a*) using the digitizer is shown in FIG. 8(*b*). The properties of the resulting zeolite are shown in Table 1.

Comparative Examples 3 to 5

Figure 9:
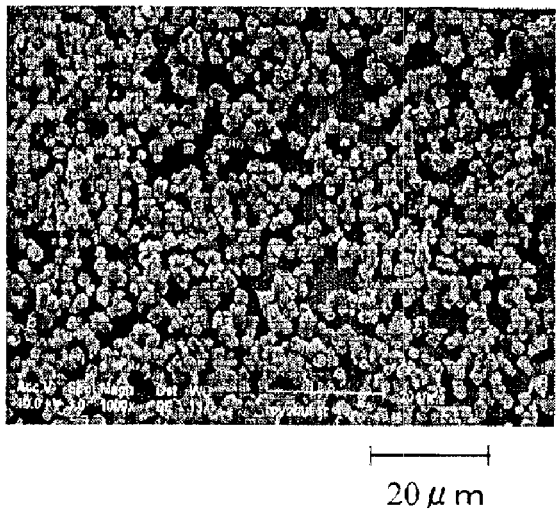
FIG. 9(*a*) is a SEM image photographed at a magnification of 1000 of zeolite used in Comparative Example 3.
Figure 9:
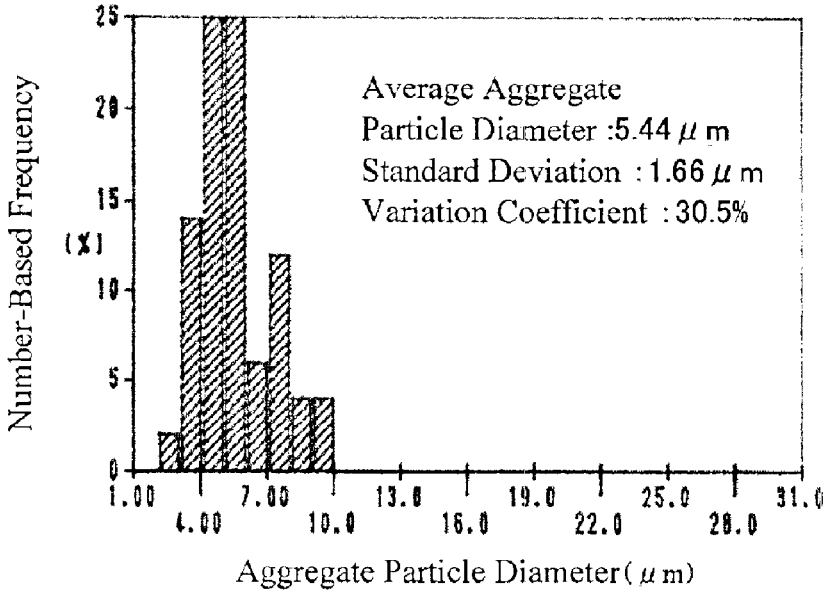
Figure 10:
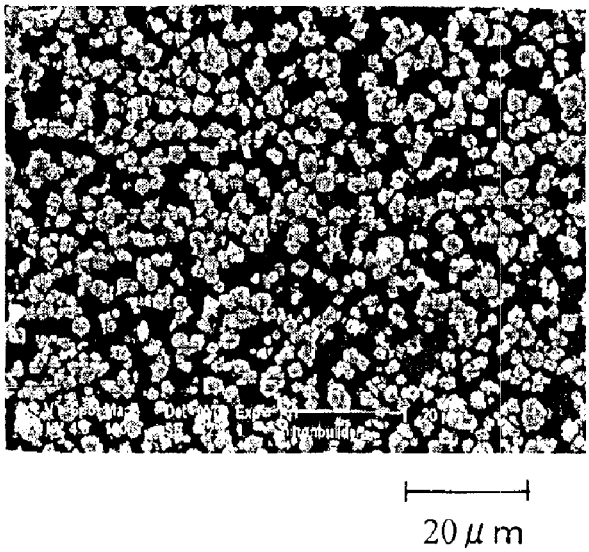
FIG. 10(*a*) is a SEM image photographed at a magnification of 1000 of zeolite used in Comparative Example 4.
Figure 10:
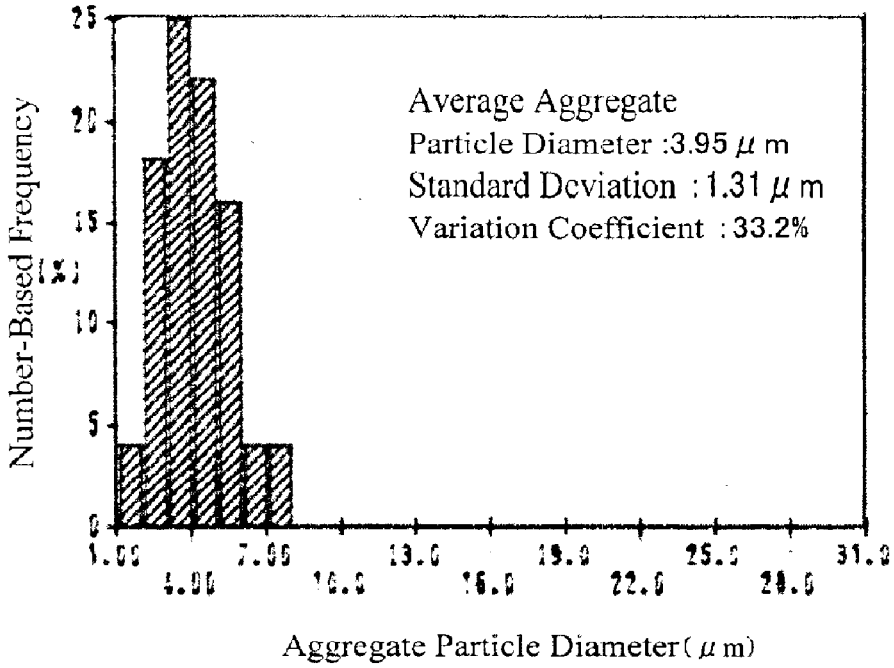
Figure 11:
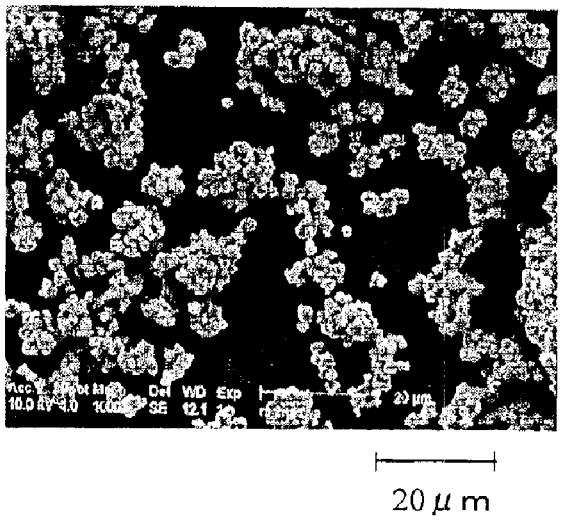
FIG. 11(*a*) is a SEM image photographed at a magnification of 1000 of zeolite used in Comparative Example 5.
Figure 11:
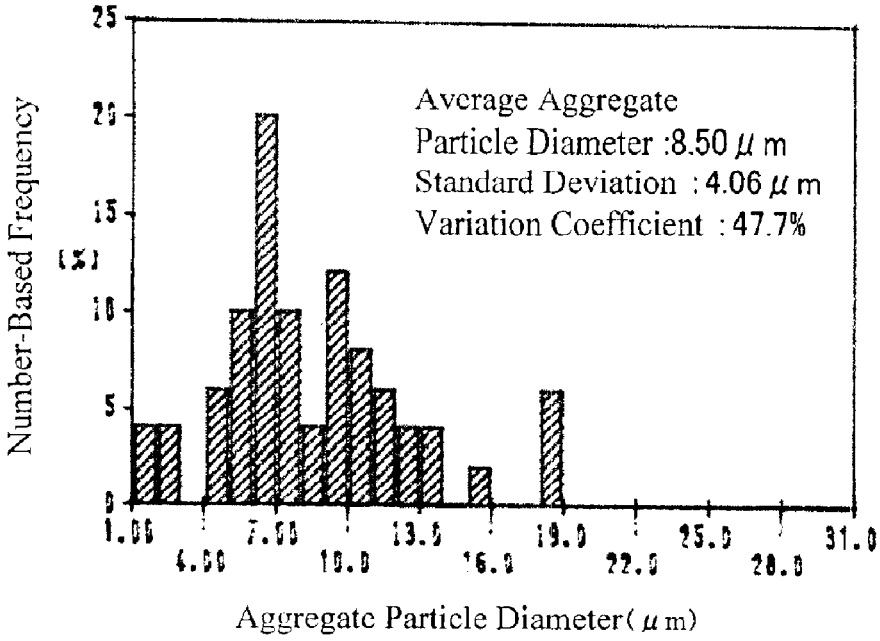

An SEM image of the powder of each of commercially available zeolite 4A-type (TOYOBUILDER, manufactured by Tosoh Corporation) as Comparative Example 3, zeolite 4A-type (Gosei Zeolite, manufactured by Nippon Builder K.K.) as Comparative Example 4, and zeolite 4A-type (SILTON B, manufactured by Mizusawa Industrial Chemicals, LTD.) as Comparative Example 5 was photographed at a magnification of 1000 using the SEM (FIGS. 9(*a*), 10(*a*) and 11(*a*)). The distributions of the aggregate particle diameters determined based on these figures using the digitizer are shown in FIGS. 9(*b*), 10(*b*) and 11(*b*). The properties of each of the resulting zeolites are shown in Table 1.

TABLE 1

| | Primary Particle Size | Aggregate Particle Diameter | | | Cationic Exchange Capacity of Zeolite Itself | | Oil- | |
|---|---|---|---|---|---|---|---|---|
| | Average Primary Particle Diameter (μm) | Average Aggregate Particle Diameter (μm) | Standard Deviation (μm) | Variation Coefficient (%) | Cationic Exchange Capacity After 1 Minute (mg $CaCO_3$/g) | Cationic Exchange Capacity After 10 Minutes (mg $CaCO_3$/g) | Absorbing Ability According to JIS K 5101 (mL/100g) | Crystal Form |
| Ex. 1 | 0.8 | 6.60 | 1.85 | 28.0 | 196 | 221 | 90 | 4A |
| Ex. 2 | 0.8 | 8.07 | 1.76 | 21.8 | 208 | 229 | 95 | 4A |
| Ex. 3 | 0.8 | 0.88 | 0.11 | 12.5 | 217 | 229 | 90 | 4A |
| Comp. Ex. 1 | 0.8 | 6.53 | 3.31 | 50.7 | 120 | 209 | 75 | 4A |
| Comp. Ex. 2 | 1.5 | 8.91 | 5.90 | 66.2 | 109 | 207 | 70 | 4A |
| Comp. Ex. 3 | 1.8 | 5.44 | 1.66 | 30.5 | 107 | 208 | 45 | 4A |
| Comp. Ex. 4 | 1.8 | 3.95 | 1.31 | 33.2 | 85 | 194 | 50 | 4A |
| Comp. Ex. 5 | 1.8 | 8.50 | 4.06 | 47.7 | 90 | 197 | 58 | 4A |

It is clear from the results shown in Table 1 that all of the zeolites obtained in Examples 1 to 3 are more excellent in the cationic exchange capacity than those of Comparative Examples 1 to 5.

In addition, it is clear from Examples 1 to 3 that the more the variation coefficient is reduced by classifying and pulverizing zeolite, the higher the cationic exchange capacity, especially the cationic exchange capacity after 1 minute.

Example 4

Base particles containing the zeolite 4A-type obtained in Example 1 were prepared by the following procedures. The formulation composition of the base particles is as shown in Table 2.

TABLE 2

| | Ex. 4 | Ex. 5 | Ex. 6 | Comp. Ex. 6 | Comp. Ex. 7 | Comp. Ex. 8 |
|---|---|---|---|---|---|---|
| (A) Zeolite having an average aggregate particle diameter of 15 μm or less and a variation coefficient of the distribution of the aggregate particle diameter of 29% or less | Zeolite of Example 1 28 parts | Zeolite of Example 2 12 parts | Zeolite of Example 3 12 parts | — | — | — |
| (B) Water-Soluble Polymer | | | | | | |
| Sodium Polyacrylate | 14 parts | 14 parts | 14 parts | 14 parts | 14 parts | 14 parts |
| (C) Water-Soluble Inorganic Salt | | | | | | |
| Sodium Sulfate | 23 parts | 23 parts | 23 parts | 23 parts | 23 parts | 23 parts |
| Sodium Chloride | 8 parts | 8 parts | 8 parts | 8 parts | 8 parts | 8 parts |
| Sodium Carbonate | 27 parts | 27 parts | 27 parts | 27 parts | 27 parts | 27 parts |
| (D) Surfactant | 0 parts (not added) | 0 parts (not added) | 0 parts (not added) | 0 parts (not added) | 0 parts (not added) | 0 parts (not added) |
| Others | | | | | | |
| Zeolite Other Than (A) | — | Commercially Available Zeolite of Comp. Ex. 3 16 parts | Commercially Available Zeolite of Comp. Ex. 3 16 parts | Commercially Available Zeolite of Comp. Ex. 3 28 parts | Commercially Available Zeolite of Comp. Ex. 4 28 parts | Commercially Available Zeolite of Comp. Ex. 5 28 parts |
| Properties of Base Particles | | | | | | |
| Water Content (% by weight) | 1.2 | 1.2 | 0.8 | 1.8 | 2.2 | 3.5 |
| Cationic Exchange Capacity After 3 Minutes (mg $CaCO_3$/g) | 217 | 149 | 164 | 136 | 131 | 109 |
| Cationic Exchange Capacity After 10 Minutes (mg $CaCO_3$/g) | 249 | 199 | 217 | 186 | 182 | 161 |
| Detergency of Detergent Particles | | | | | | |
| Deterging Rate (%) | 50 | 45 | 50 | 35 | 33 | 30 |

Note: "parts" as used herein means "parts by weight."

Ion-exchanged water was added to a mixer (capacity: 180 L) having agitation impellers with a length of 200 mm, and heated with stirring. After the water temperature reached 55° C., sodium carbonate (DENSE ASH, manufactured by Central Glass Co., Ltd) was added thereto. Next, sodium sulfate (neutral anhydrous sodium sulfate, manufactured by Shikoku Kasei K.K.) was added to the mixture, and the resulting mixture was stirred for 15 minutes. Thereafter, a 40% by weight-aqueous sodium polyacrylate (weight-average molecular weight: 10000, manufactured by Kao Corporation) was added thereto. Then, sodium chloride (roast salt, manufactured by Nihon Seien Co., Ltd.) was added thereto, and the resulting mixture was stirred for 15 minutes. Subsequently, the zeolite 4A-type obtained in Example 1 was added thereto, and the resulting mixture was stirred for 30 minutes, to give 60 kg of a homogeneous slurry (water content: 53% by weight). This slurry was spray-dried to give base particles having a water content of 1.2% by weight.

Next, detergent particles were prepared by the following procedures.

There were mixed together at a temperature of 80° C., 10.5 parts by weight of a polyoxyethylene alkyl ether (EMULGEN 108KM, manufactured by Kao Corporation), 0.4 parts by weight of a polyethylene glycol (K-PEG6000, manufactured by Kao Corporation), palmitic acid (LUNAC P-95, manufactured by Kao Corporation) in an amount equivalent to 2 parts by weight of sodium palmitate, LAS acid precursor (NEOPELEX FS, manufactured by Kao Corporation) in an amount equivalent to 12.5 parts by weight of LAS-Na, and an aqueous sodium hydroxide as a neutralizing agent, thereby giving a surfactant-containing liquid mixture. Next, 50 parts by weight of the base particles previously prepared were supplied into a Lödige Mixer (capacity: 20 L; manufactured by Matsuzaka Giken Co., Ltd.), and the surfactant-containing liquid mixture was sprayed to the base particles with stirring. Thereafter, 10 parts by weight of a crystalline silicate (SKS6, manufactured by Clariant), and 7 parts by weight of a commercially available zeolite (TOYOBUILDER, manufactured by Tosoh Corporation) were added thereto, to give detergent particles.

The properties of the resulting base particles and detergent particles are shown in Table 2 below.

Example 5

Base particles containing the zeolite 4A-type obtained in Example 2 were prepared by the following procedures. The formulation composition of the base particles is as shown in Table 2.

Ion-exchanged water was added to the same mixer as in Example 4, and an aqueous slurry (20% by-weight slurry) of the zeolite obtained in Example 2 was added thereto. The resulting mixture was heated with stirring. After the water temperature reached 55° C., sodium carbonate (DENSE ASH, manufactured by Central Glass Co., Ltd) was added thereto. Next, sodium sulfate (neutral anhydrous sodium sulfate, manufactured by Shikoku Kasei K.K.) was added to the mixture, and the resulting mixture was stirred for 15 minutes. Thereafter, a 40% by weight-aqueous sodium polyacrylate (weight-average molecular weight: 10000, manufactured by Kao Corporation) was added thereto. Sodium chloride (roast salt, manufactured by Nihon Seien Co., Ltd.) was added to the mixture, and the resulting mixture was stirred for 15 minutes. Subsequently, the commercially available zeolite used in Comparative Example 3 (TOYOBUILDER, manufactured by Tosoh Corporation) was added to the mixture, and the resulting mixture was stirred for 30 minutes, to give 60 kg of a homogeneous slurry (water content: 53% by weight). This slurry was spray-dried to give base particles having a water content of 1.2% by weight.

Next, detergent particles were prepared in the same manner as in Example 4 except that the base particles obtained as above were used.

Example 6 and Comparative Examples 6 to 8

Base particles and detergent particles were prepared in the same manner as in Example 5 except that the zeolite obtained in Example 3 was used in Example 6. Also, base particles and detergent particles were prepared in the same manner as in Example 4, except that the commercially available zeolite described in Comparative Example 3 (TOYOBUILDER, manufactured by Tosoh Corporation) was used in Comparative Example 6, that the commercially available zeolite described in Comparative Example 4 (Gosei Zeolite, manufactured by Nippon Builder K.K.) was used in Comparative Example 7, and that the commercially available zeolite described in Comparative Example 5 (SILTON B, manufactured by Mizusawa Kagaku) was used in Comparative Example 8.

As is clear from the results shown in Table 2, all of the base particles had a higher cationic exchange capacity and all of the detergent particles had a higher detergency, in each of Examples 4 to 6, as compared with those of Comparative Examples 6 to 8.

In addition, in the commercially available zeolites of Comparative Examples 4 and 5, the cationic exchange capacities of the zeolites themselves, as shown in Table 1 are nearly the same level. However, there is a distinct difference in the cationic exchange capacity in the base particle contained in the base particles of Comparative Examples 7 and 8, the base particles containing the zeolite of Comparative Example 4 being more excellent. This reflects the difference of the distribution of the aggregate particle diameter of both zeolites. The zeolite of Comparative Example 4 (variation coefficient of the distribution of the aggregate particle diameter: 33.3%) is a zeolite with a more even distribution of the aggregate particle diameter as compared to that of Comparative Example 5 (variation coefficient of the distribution of the aggregate particle diameter: 47.7%), so that the cationic exchange capacity of the base particles containing the zeolite of Comparative Example 4 is improved as compared to those containing Comparative Example 5. As described above, it is effective to formulate a zeolite having an even distribution of the aggregate particle diameter in order to improve the performance of the base particles, and this fact is supported by the results of Examples of the present invention.

Since the base particles of the present invention comprising a zeolite having an even distribution of the aggregate particle diameter are excellent in the cationic exchange capacity, a detergent having a high cationic exchange capacity is obtained by formulating the detergent particles comprising the base particles, thereby improving the washing performance.

What is claimed is:

1. Base particles for supporting a surfactant, obtainable by a step of spray-drying a slurry comprising:

(A) a zeolite having an average aggregate particle diameter of 15 $\mu$m or less and a variation coefficient of a distribution of an aggregate particle diameter of 29% or less;

(B) a water-soluble polymer;

(C) a water-soluble salt; and (D) a surfactant in an amount of 5% by weight or less of the slurry.

2. The base particles according to claim 1, wherein the component (A) is a zeolite having a composition represented by a general formula:

$$xM_2O.ySiO_2.Al_2O_3.zMeO,$$

wherein M is an alkali metal atom, Me is an alkaline earth metal atom, x is a number of from 0.5 to 1.5, y is a number of from 0.5 to 6, and z is a number of from 0 to 0.1.

3. The base particles according to claim 1 or 2, wherein the component (A) is obtainable by a process comprising mixing an aluminum source and/or a silica source under the presence of an alkaline earth metal-containing compound.

4. The base particles according to claim 2, wherein a raw material used in the preparation of the component (A) has a compositional ratio such that an $SiO_2/Al_2O_3$ molar ratio is 0.5 or more and 6 or less; an $M_2O/Al_2O_3$ molar ratio is 0.2 or more and 8.0 or less; and an $MeO/Al_2O_3$ molar ratio is 0 or more and 0.1 or less.

5. The base particles according to claim 4, wherein the $MeO/Al_2O_3$ molar ratio is 0.005 or more and 0.1 or less.

6. The base particles according to claim 1 or 2, wherein the base particles have a 10-minute cationic exchange ability of 190 mg $CaCO_3$/g or more.

7. Detergent particles comprising the base particles of claim 1 or 2.

8. A zeolite for a laundry detergent, wherein the zeolite has an average aggregate particle diameter of 15 $\mu$m or less and a variation coefficient of a distribution of an aggregate particle diameter of 29% or less.

9. A process for preparing base particles for supporting a surfactant, comprising a step of spray-drying a slurry comprising a zeolite (A) having an average aggregate particle diameter of 15 $\mu$m or less and a variation coefficient of a distribution of an aggregate particle diameter of 29% or less, a water-soluble polymer (B), a water-soluble salt (C), and optionally a surfactant (D) so as to give base particles comprising:

1 to 90% by weight of the zeolite (A);

2 to 25% by weight of the water-soluble polymer (B);

5 to 75% by weight of the water-soluble salt (C); and optionally 0 to 5% by weight of the surfactant (D).

10. The process according to claim 9, wherein the slurry comprises:

0.5 to 70% by weight of the zeolite (A);

1 to 20% by weight of the water-soluble polymer (B);

1 to 60% by weight of the water-soluble salt (C); and optionally 0 to 5% by weight of the surfactant (D).

11. The base particles according to claim 1, wherein the zeolite is prepared by an embodiment of pulverizing a raw material zeolite.

12. The base particles according to claim 1, wherein the zeolite is prepared by an embodiment of classifying a raw material zeolite.

13. The base particles according to claim 1, wherein the zeolite is prepared by feeding an aluminum source and/or a silica source to a circulating line of a reaction vessel having the circulating line with a mixing device to react the components, while a vigorous stirring is carried out at a peripheral speed of the mixing device of not less than 11 m/s.

* * * * *